US005995005A

United States Patent [19]

Hayashi

[11] Patent Number: 5,995,005

[45] **Date of Patent: *Nov. 30, 1999**

[54] THEFT CHECKING SYSTEM

[75] Inventor: Michinari Hayashi, Nisshin, Japan

[73] Assignee: Maspro Denkoh Company, Ltd., Aichi, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/817,849

[22] PCT Filed: Aug. 27, 1996

[86] PCT No.: PCT/JP96/02398

§ 371 Date: Apr. 25, 1997

§ 102(e) Date: Apr. 25, 1997

[87] PCT Pub. No.: WO97/08673

PCT Pub. Date: Mar. 6, 1997

[30] Foreign Application Priority Data

Aug. 29, 1995 [JP] Japan ..... 7-220861

[51] Int. Cl.[6] ..... G08B 13/14

[52] U.S. Cl. ..... 340/572.4; 340/529

[58] Field of Search ..... 340/572, 529, 340/572.4

[56] References Cited

U.S. PATENT DOCUMENTS

| | | | |
|---|---|---|---|
| 4,429,302 | 1/1984 | Vandebult | 340/572 |
| 4,531,117 | 7/1985 | Nourse et al. | 340/572 |
| 4,779,077 | 10/1988 | Lichtblau | 340/572 |
| 4,812,822 | 3/1989 | Feltz et al. | 340/572 |
| 5,353,011 | 10/1994 | Wheeler et al. | 340/572 |

FOREIGN PATENT DOCUMENTS

| | | |
|---|---|---|
| 126094 | 5/1988 | Japan . |
| 120691 | 4/1992 | Japan . |
| 139467 | 5/1994 | Japan . |
| 209270 | 7/1994 | Japan . |

*Primary Examiner*—Thomas Mullen
*Attorney, Agent, or Firm*—Pearson & Pearson

[57] ABSTRACT

A theft checking system that improves detection precision of theft checking systems. A micrometer samples data of received signals for three periods of a swept signal. A signal analyzer confirms signals that are regarded as resonance signals occurring in each of the first half and the second half of the first period, ignoring noise signals, and determines only whether similar signals corresponding to the resonance signals are present in each of the following two periods. A detection circuit recognizes the presence of the resonance signals and thereby recognizes and notifies passage of a tagged article.

4 Claims, 3 Drawing Sheets

THEFT CHECKING SYSTEM

TECHNICAL FIELD

The present invention relates to a theft checking system wherein a tag incorporating a resonance circuit is attached to an article and, utilizing the fact that if the tagged article is caused to pass between transmission and reception antennas disposed facing each other the resonance circuit picks up electromagnetic waves outputted from the transmission antenna and undergoes resonance, the reception antenna receives the electromagnetic waves re-radiated from the resonance circuit and passage of the tagged article is detected.

BACKGROUND ART

The theft checking system uses a short wave band centered at, for example, 8.2 MHz, and the electromagnetic waves radiated from the transmission antenna are weak so that they are susceptible to communication signals, electromagnetic waves from fluorescent lamps or office automation appliances, and the like, which intrude as noises.

The influence of noises can be reduced relatively easily by increasing the electromagnetic wave transmission power, increasing the resonance circuit in size, or reducing the detection area. However, an increase in the electromagnetic wave transmission power is only permitted within a limit, and a size increase of the resonance circuit results in a correspondingly increased size of the tag, which is unfavorable.

A reduction in the detection area will by no means be acceptable to consumers when the demand for enlarged detection areas is presently increasing.

Accordingly, a conventional technology is proposed, as described in, for example, Japanese Patent Laid-Open No. Sho 63-126094, wherein two types of resonance circuits having different resonance frequencies are incorporated in a tag, and the electromagnetic waves to be transmitted are subjected to sweeping, and if the re-radiated electromagnetic waves are received from the two types of resonance circuits a total of four times during a period of sweep, validity is established and a detection signal is outputted.

The aforementioned technology achieves a high detection precision since it detects only re-radiated electromagnetic waves while ignoring eruptive noises. However, the tag doubles in size and thus offends the eye.

Moreover, if a signal indistinct from the resonance signal is detected four times within a period of sweep, the signal is mistaken as a resonance signal and false determination is made.

DISCLOSURE OF THE INVENTION

The present invention is a theft checking system that recognizes a difference between resonance signals and noises based on inter-period relationship of the number of occurrences and occurrence timing of signals detected within each of consecutive cycle periods, thereby reducing the possibility of errors to a minimum level. The system features a construction wherein a transmission antenna outputs electromagnetic waves of a constant amplitude in which periodical sweep is made between predetermined frequencies, and the resonance frequency of the resonance circuit is set so that it is lower than a frequency at the upper limit of the output electromagnetic waves and higher than a frequency corresponding to the lower limit thereof, and analysis means is provided for, if a signal is detected twice or more within the period of the sweep, first extracting from the signals a pair of signals that are regarded as resonance signals, and then determining whether a signal substantially agreeing in occurrence timing and pattern with the extracted signals is present in at least one of the periods preceding and following the period during which the extracted signals are detected, and recognizing passage of the tagged article by confirming the presence of such a signal. Preferably, the sweep frequency of the signal outputted from the transmission antenna is a frequency such that detection can be made while a person is passing by or walking between the transmission and reception antennas, and the presence of a signal substantially agreeing in occurrence timing and pattern with extracted signals is determined in connection with each of three consecutive periods of sweep.

BRIEF DESCRIPTION OF THE INVENTION

BEST MODE FOR CARRYING OUT THE INVENTION

An embodiment of an theft checking apparatus according to the present invention will be described with reference to the drawings.

Figure 1:
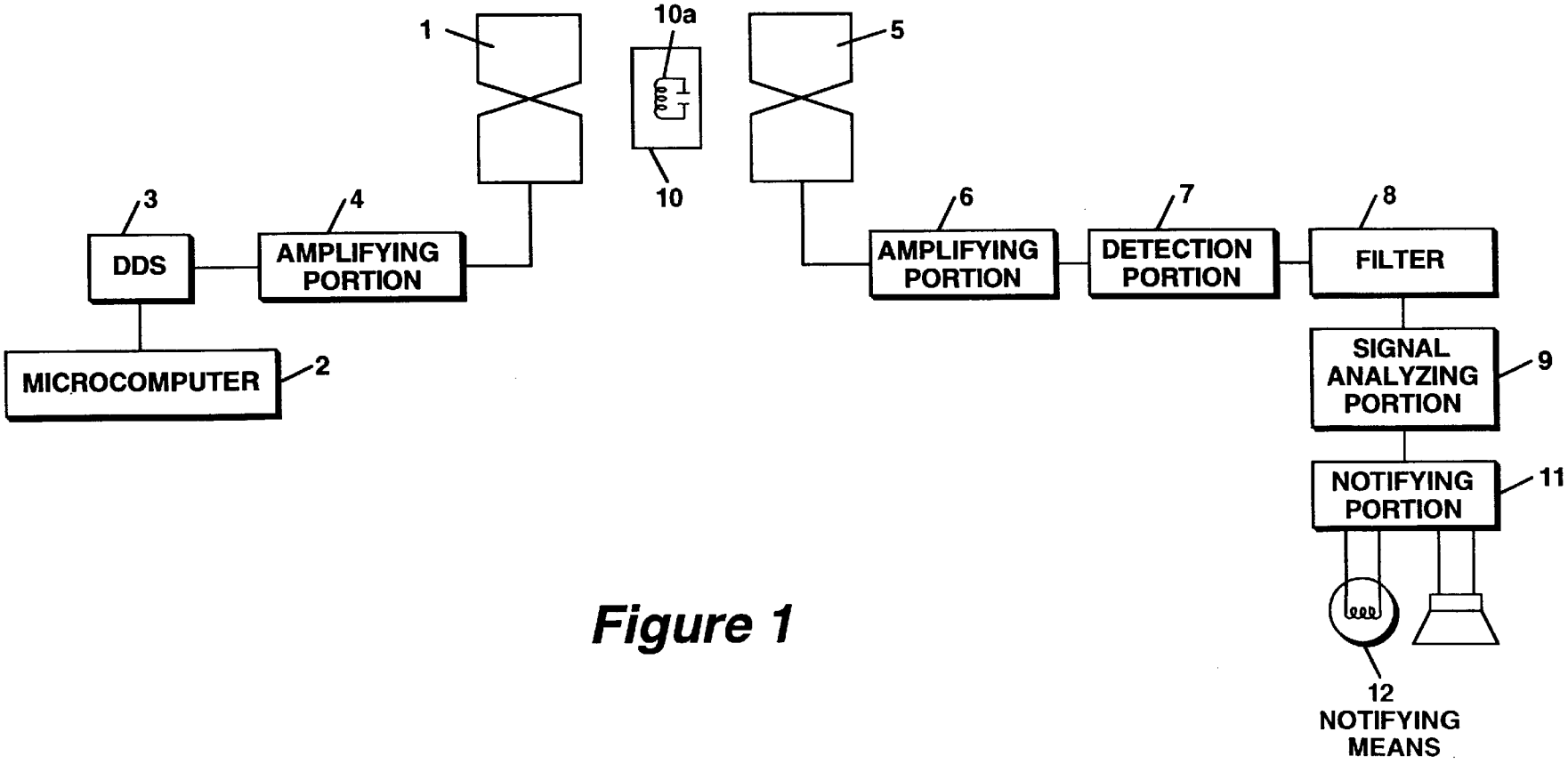
FIG. 1 is a block diagram illustrating a theft checking system according to the present invention.
Figure 2:
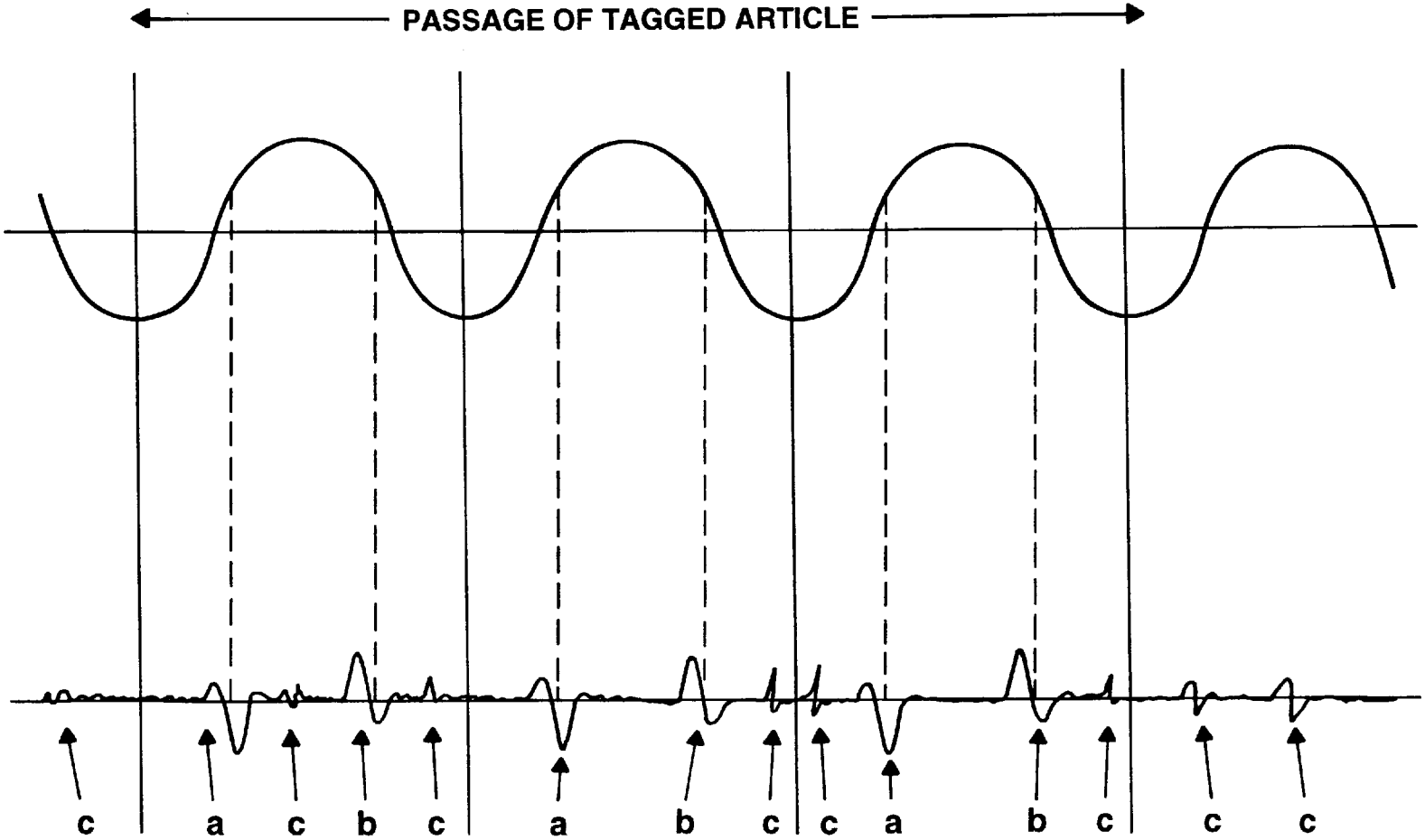
FIG. 2 is a diagram illustrating the analysis principle.

FIG. 1 is a block diagram of a theft checking system according to the present invention, and FIG. 2 illustrates the principle of analysis means of the theft checking system. In accordance with an instruction from a computer (microcomputer) 2, a signal in which sine-wave sweep is made within a range of 7.4 MHz–8.9 MHz at a frequency of approximately 140 Hz, which is considered optimal for detection within a time of passage of a tagged article between the transmission and reception antenna at an average human walking speed, is sent from a DDS 3 through an amplifying portion 4 to a transmission antenna 1, which thereby radiates electromagnetic waves.

A reception antenna 5 receives electromagnetic waves radiated from the transmission antenna 1. The received signal is sent through an amplifying portion 6 to a detection portion 7, and the signal thereby detected is outputted through a filter 8 to a signal analyzing portion 9.

When a tag 10 having a resonance circuit 10*a* comes in between the transmission antenna 1 and the reception antenna 5, a resonance signal is re-radiated from the tag 10, and the re-radiated electromagnetic waves are received by the reception antenna 5 together with various noises and electromagnetic waves radiated from the transmission antenna 1.

The embodiment employs a band-pass filter as the filter 8. However, it may be a low-pass filter or a high-pass filter.

Assuming that the frequency of the resonance circuit 10*a* is, for example, 8.2 MHz, which is within the range of the transmission signal, that is, 7.4 MHz to 8.9 MHz, the resonance signals a, b from the tag are continually received in individual periods of sweep while the tag 10 remains in the detection area.

Those signals have regularity by occurring twice within the sweep period, that is, once in the first half and once in the second half of a sweep, and the waveform phases in the first and second halves are opposite to each other, and the occurrence timings and patterns in individual periods substantially agree with one another.

Figure 3:
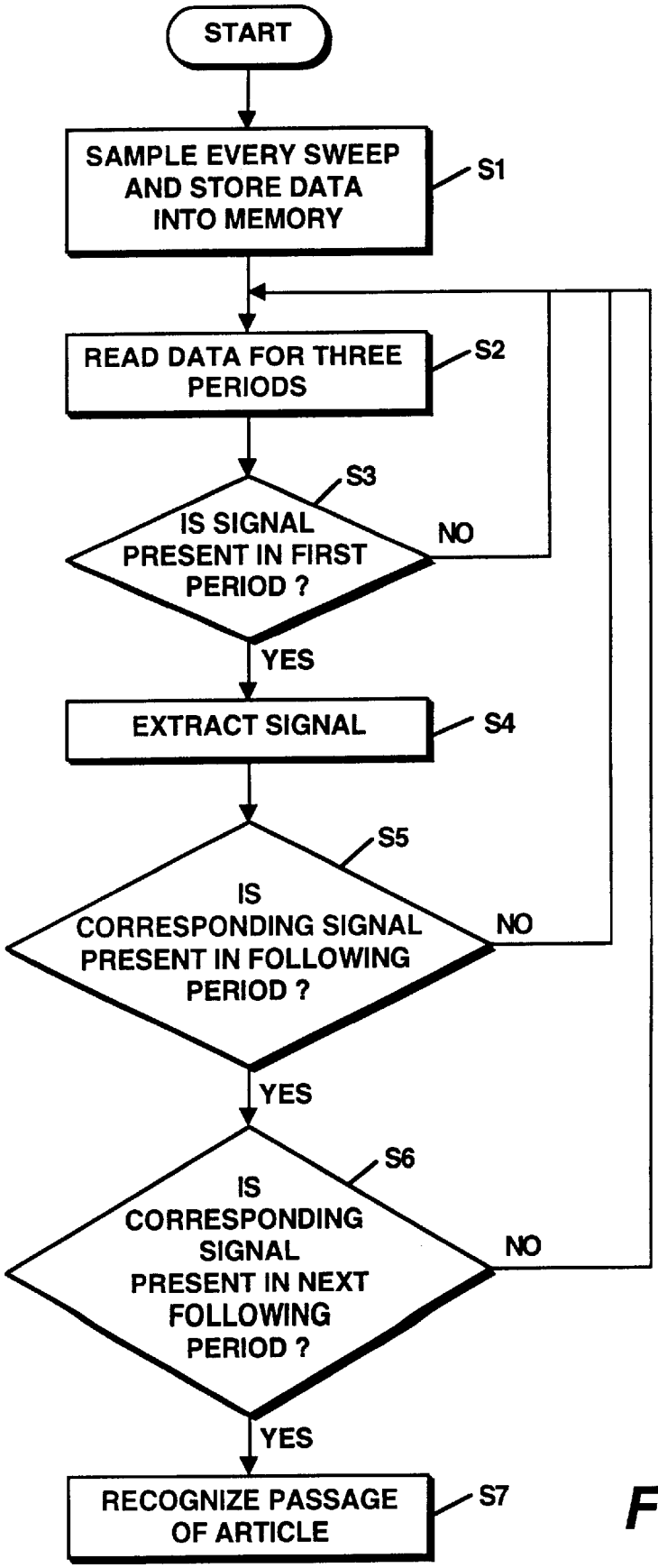
FIG. 3 is a flowchart illustrating the analysis processing.

In contrast, an eruptively occurring noise c has no regularity. Therefore, the analyzing portion 9 distinguishes resonance signals from noises by processing the received signals in accordance with, for example, the flowchart shown in FIG. 3.

First, S1 samples data from the detection signal for every sweep and stores the data into a memory. S2 reads data for three consecutive periods stored in the memory, and S3 searches for the presence of a signal in the first period.

In a case where there is any signal in the first period, if the signal contains a resonance signal, the signal should be received totally at least twice in the period, that is, once in the first half and once in the second half.

Therefore, if signals are detected at least once in each of the first and second halves of the period, it is determined whether the signals include a pair of signals that satisfy the condition that the signals are opposite in phase to each other. If a pair of signals satisfying the condition are confirmed, S4 extracts the pair of signals satisfying the condition.

The extracted signals have possibility of being resonance signals.

S5 determines whether signals corresponding to the extracted signals are present in the following period. If there are signals having the same occurrence timing and pattern, it is determined that the possibility that those signals are resonance signals is very high, and the operation proceeds to S6.

S6 determines whether signals corresponding to the extracted signals are present in the next following period. If there are substantially agreeing signals in the three consecutive periods, it is determined that the signals are resonance signals. Thus S7 regards them as resonance signals, thereby recognizing passage of a tagged article.

When passage of a tagged article is recognized, a signal is outputted to a notifying portion 11, which produces an alarm by notifying means 12, for example a lamp or a buzzer.

If S3 does not detect above-described signals, or if S4 does not confirm corresponding signals, the operation returns to S2, which reads the data for the three sweeps that are shifted one period, thus repeatedly performing the analysis processing.

Noises are thus excluded from the waveform over a plurality of periods if there is any noise contamination. Therefore, if there is a waveform indistinct from the resonance signal or a high-level signal, such a signal will not be mistaken as a resonance signal.

Although the embodiment determines whether signals that satisfy the predetermined condition are present in each of three consecutive periods, the determination may be made over two consecutive periods, or may also be made over four or more periods depending on the conditions of noise occurrence.

Since the embodiment compares signals in consecutive periods on the basis of the occurrence timing and pattern of resonance electromagnetic waves that occur twice in a sweep in order to determine whether a signal is true or false as described above, the reliability becomes high. Since noises will not be mistaken as resonance signals, the embodiment can reliably be applied in an environment with many noises that are hard to distinguish from resonance signals.

According to the present invention, the band used for the transmission frequency and the sweep frequency may be suitably changed. The resonance frequency of the resonance circuit of a tag may also be freely set within a range that is lower than the frequency at the upper limit of the transmission electromagnetic waves and higher than the frequency corresponding to the lower limit thereof.

If the sweep frequency is set to a high value, the pattern of resonance signal will deteriorate, making discrimination impossible. If it is excessively low, passage through the detection zone may be completed before completion of one period of sweep. Therefore, in the present situation where a short wave band is used, the practical sweep frequency would be 50 to one hundred and several tens Hz. In such a case, it is preferred that the determination be made regarding each of three consecutive periods.

The present invention encompasses all controls that use the signal occurrence timing and pattern in each of consecutive periods as bases for determination. It is possible to retrieve a period and make comparison with a preceding or following period, or collectively retrieve a plurality of periods and collectively analyze signals in each of the periods.

ADVANTAGE OF THE INVENTION

According to the present invention, since any signal having no regularity, that is, any signal that does not exhibit continually the same occurrence timing and pattern, is determined as a noise regardless of whether reception occurs in a one-shot fashion or intermittently, only resonance signals are recognized.

Moreover, since a tag needs to contain only a single resonance circuit, miniaturization of a tag is facilitated.

Further, if analysis is performed over three periods, the detection precision will become nearly 100%. If a short wave is used, the sweep frequency may be set to 50 to one hundred and several tens Hz, so that deterioration of the power of distinguishing signals occurring in a period will not result and so that escape from the detection area before receiving a plurality of periods will not occur. Thus, the danger of detection error will be eliminated and the reliability will be high.

I claim:

1. A theft checking system comprising:

a tag including a resonance circuit attached to an article;

a transmission antenna and a reception antenna disposed facing each other;

said resonance circuit of said tag picks up predetermined electromagnetic waves outputted from said transmission antenna and undergoes resonance;

said reception antenna receives said predetermined electromagnetic waves re-radiated from said resonance circuit when passage of said tagged article occurs between said transmission antenna and said reception antenna;

said transmission antenna outputs said electromagnetic waves having a constant amplitude and a periodical sweep between predetermined frequencies;

said resonance circuit comprises a resonance frequency which is set lower than a frequency at an upper limit of said electromagnetic waves from said transmission antenna and higher than a frequency corresponding to a lower limit thereof;

analysis means for determining if said re-radiated electromagnetic waves are detected at least twice having opposite phases within the period of the sweep, wherein a detected occurrence of said re-radiated electromagnetic waves does not require the presence of a predetermined number of predefined lobes within said electromagnetic waves;

said analysis means first extracting from said re-radiated electromagnetic waves a first pair of resonant signals and then determining whether another pair of resonant signals substantially agree in occurrence timing and pattern with the extracted first pair of resonant signals in at least one of the periods preceding and following the period during which said extracted first pair of resonant signals is detected; and said analysis means recognizes passage of said tagged article by confirming the presence of said resonant signals in said preceding and following periods.

2. A theft checking system according to claim 1 wherein said electromagnetic waves outputted from the transmission antenna comprises said resonant frequency such that detection can be made while a person carrying said tagged article passes between the transmission and reception antennas.

3. A theft checking system according to claim 2 wherein the presence of signals substantially agreeing in occurrence timing and pattern with the extracted resonant signals is determined for each of three consecutive periods of sweep.

4. A theft checking system according to claim 1 wherein the presence of signals substantially agreeing in occurrence timing and pattern with the extracted resonant signals is determined for each of three consecutive periods of sweep.

* * * * *